US010317064B2

(12) United States Patent
Ozawa et al.

(10) Patent No.: US 10,317,064 B2
(45) Date of Patent: Jun. 11, 2019

(54) LIGHT SOURCE UNIT AND VEHICLE LAMP FITTING

(71) Applicant: KOITO MANUFACTURING CO., LTD., Tokyo (JP)

(72) Inventors: Atsushi Ozawa, Shizuoka (JP); Tomoyuki Nakagawa, Shizuoka (JP); Tsutomu Machida, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 8 days.

(21) Appl. No.: 15/561,646

(22) PCT Filed: Mar. 16, 2016

(86) PCT No.: PCT/JP2016/058357
§ 371 (c)(1),
(2) Date: Sep. 26, 2017

(87) PCT Pub. No.: WO2016/158423
PCT Pub. Date: Oct. 6, 2016

(65) Prior Publication Data

US 2018/0073714 A1 Mar. 15, 2018

(30) Foreign Application Priority Data

Mar. 31, 2015 (JP) ..... 2015-072897
Jul. 27, 2015 (JP) ..... 2015-147768

(51) Int. Cl.
*F21V 29/503* (2015.01)
*F21V 23/06* (2006.01)
(Continued)

(52) U.S. Cl.
CPC ..... *F21V 29/503* (2015.01); *F21S 41/143* (2018.01); *F21S 41/192* (2018.01); *F21S 41/194* (2018.01);
(Continued)

(58) Field of Classification Search
CPC ..... F21S 41/00; F21S 41/141; F21S 41/192; F21S 43/00; F21S 43/14; F21S 43/195;
(Continued)

(56) References Cited

U.S. PATENT DOCUMENTS

2012/0098427 A1* 4/2012 Miyagishima ..... H01J 5/54 315/51
2016/0061404 A1 3/2016 Kosugi et al.

FOREIGN PATENT DOCUMENTS

JP 2011-171277 A 9/2011
JP 2013-025934 A 2/2013
(Continued)

OTHER PUBLICATIONS

International Search Report (PCT/ISA/210) dated Jun. 14, 2016 issued by the International Searching Authority in counterpart International Application No. PCT/JP2016/058357.
(Continued)

*Primary Examiner* — Hargobind S Sawhney
(74) *Attorney, Agent, or Firm* — Sughrue Mion, PLLC

(57) ABSTRACT

A light source unit includes a light emitting element which functions as a light source, a wiring pattern on which the light emitting element is mounted, an electrode pad connected to the wiring pattern, a substrate on which the wiring pattern is formed and the electrode pad is mounted, a power supply body which supplies external power to the electrode pad, and a socket housing which has an engaging portion engaged with a predetermined member and holds the substrate, the light emitting element and the power supply body. The power supply body has a terminal holding portion formed of an insulating resin material and a connection terminal supported by the terminal holding portion and connected to an external power supply. The connection
(Continued)

terminal and the electrode pad are connected to each other by a conduction connecting part.

9 Claims, 9 Drawing Sheets

(51) Int. Cl.

| | |
|---|---|
| ***F21S 43/00*** | (2018.01) |
| ***F21S 43/37*** | (2018.01) |
| ***F21S 43/19*** | (2018.01) |
| ***F21V 19/00*** | (2006.01) |
| ***F21S 43/14*** | (2018.01) |
| ***F21S 41/19*** | (2018.01) |
| ***F21S 41/143*** | (2018.01) |
| ***F21S 45/48*** | (2018.01) |
| *F21V 15/00* | (2015.01) |
| *F21V 17/00* | (2006.01) |
| *F21V 29/74* | (2015.01) |
| *F21S 45/50* | (2018.01) |

(52) U.S. Cl.
CPC ..... *F21S 43/00* (2018.01); *F21S 43/14* (2018.01); *F21S 43/19* (2018.01); *F21S 43/195* (2018.01); *F21S 43/37* (2018.01); *F21S 45/48* (2018.01); *F21V 19/003* (2013.01); *F21V 23/06* (2013.01); *F21S 45/50* (2018.01); *F21V 15/00* (2013.01); *F21V 17/005* (2013.01); *F21V 29/74* (2015.01)

(58) Field of Classification Search
CPC ..... F21S 43/27; F21V 23/004; F21V 23/005; F21V 23/06
See application file for complete search history.

(56) References Cited

FOREIGN PATENT DOCUMENTS

| | | | |
|---|---|---|---|
| JP | 2013-235649 | A | 11/2013 |
| JP | 2014-170716 | A | 9/2014 |
| JP | 2015-060753 | A | 3/2015 |

OTHER PUBLICATIONS

Written Opinion (PCT/ISA/237) dated Jun. 14, 2016 issued by the International Searching Authority in counterpart International Application No. PCT/JP2016/058357.
Communication dated Jul. 17, 2018, issued by the European Patent Office in counterpart European Application No. 16772306.3.

* cited by examiner

LIGHT SOURCE UNIT AND VEHICLE LAMP FITTING

This application claims priority from Japanese Patent Applications No. 2015-072897 filed on Mar. 31, 2015 and No. 2015-147768 filed on Jul. 27, 2015, the entire contents of which are incorporated herein by reference.

TECHNICAL FIELD

The present invention relates to a technical field of a light source unit including a socket housing and a substrate disposed in the socket housing, and a vehicle lamp including the same.

CITATION LIST

Patent Document

Patent Document 1: JP 2013-25934 (A)

BACKGROUND ART

For example, there is a vehicle lamp in which a light source unit detachably attached to a lamp outer housing constituted by a lamp body and a cover is provided and a light emitting element such as a light emitting diode is used as a light source of the light source unit.

In such a light source unit, a light emitting element serving as a light source and a substrate on which a wiring pattern for supplying current to at least the light emitting element is formed are provided, and the substrate is disposed in a socket housing (e.g, see Patent Document 1).

In the light source unit disclosed in Patent Document 1, the socket housing in which the substrate is disposed is attached to a lamp body. A part of a power supply member (connection terminal) for supplying power to the light emitting element or the like is inserted through the substrate, and the portion of the power supply member inserted through the substrate is bonded to the substrate by a conductive metal member (solder).

A back side of the substrate is in contact with a heat conducting metal member, and heat generated at the time of emitting light from the light emitting element is released via the heat conducting metal member.

DISCLOSURE OF INVENTION

Problems to be Solved by Invention

However, in the light source unit disclosed in Patent Document 1, a part of the power supply member is inserted through the substrate, the portion of the power supply member inserted through the substrate is bonded to the substrate by the conductive metal member, and the heat conducting metal member is provided only at a position facing the central portion of the substrate in order to avoid interference between the heat conducting metal member and the power supply member.

Accordingly, the contact area of the heat conducting metal member with the substrate is so small that sufficient heat-dissipation properties may not be ensured at the time of emitting light from the light emitting element.

Therefore, the light source unit and the vehicle lamp of the present invention overcome the above problem and aim to improve the heat-dissipation properties relating to the heat generated at the time of emitting light from the light emitting element.

Means for Solving the Problems

As a first aspect, a light source unit according to the present invention includes a light emitting element that functions as a light source, a wiring pattern on which the light emitting element is mounted, an electrode pad connected to the wiring pattern, a substrate on which the wiring pattern is formed and the electrode pad is mounted, a power supply body that supplies external power to the electrode pad, and a socket housing which has an engaging portion engaged with a predetermined member and holds the substrate, the light emitting element and the power supply body. The power supply body has a terminal holding portion formed of an insulating resin material, and a connection terminal supported by the terminal holding portion and connected to an external power supply.

The connection terminal and the electrode pad are connected to each other by a conduction connecting part.

In this way, since the connection terminal of the power supply body is positioned outside the substrate, the heat-dissipation area of the substrate can be increased.

As a second aspect, in the light source unit according the present invention described above, it is preferable that one end portion of the connection terminal of the power supply body is located adjacent to the substrate, and at least the portions of the power supply body excluding both end portions are located inside the socket housing.

In this way, a distance between the connection terminal and the substrate is shortened, and the power supply body is located so as not to protrude largely from the socket housing.

As a third aspect, in the light source unit according the present invention described above, it is preferable that the power supply body is formed by integrally molding the terminal holding portion and the connection terminal, and the power supply body and the socket housing are coupled by being integrally molded.

In this way, the power supply body and the socket housing are coupled by being integrally molded after the power supply body is formed by the integral molding.

As a fourth aspect, in the light source unit according the present invention described above, it is preferable that a shielding member for shielding at least the conduction connecting part, a positioning hole is formed in one of the socket housing and the shielding member and a positioning pin inserted through the positioning hole is provided in the other, and the shielding member is attached to the socket housing in a state where the positioning pin is inserted through the positioning hole.

In this vvay, the conduction connecting part is shielded by the shielding member, and thus, fingers or the like are not inadvertently brought into contact with the conduction connecting part when gripping the light source unit.

As a fifth aspect, another light source unit according to the present invention includes a light emitting element that functions as a light source, a wiring pattern on which the light emitting element is mounted, an electrode pad connected to the wiring pattern, a substrate on which the wiring pattern is formed and the electrode pad is mounted, a power supply body that supplies external power to the electrode pad, and a socket housing which has an engaging portion engaged with a predetermined member and holds the substrate, the light emitting element and the power supply body. A placement recess in which the substrate is placed is formed in the socket housing, a part of the connection terminal to be connected to a power supply circuit is positioned in the portion of the placement recess between the substrate and the engaging portion, and the connection terminal and the electrode pad are connected to each other by a conduction connecting part.

In this way, since the connection terminal of the power supply body is positioned in the portion of the placement recess outside the substrate, the heat-dissipation area of the substrate can be increased.

As a sixth aspect, a vehicle lamp according to the present invention is a vehicle lamp including a light source unit. The light source unit includes a light emitting element that functions as a light source, a wiring pattern on which the light emitting element is mounted, an electrode pad connected to the wiring pattern, a substrate on which the wiring pattern is formed and the electrode pad is mounted, a power supply body that supplies external power to the electrode pad, a socket housing which has an engaging portion engaged with a predetermined member and holds the substrate, the light emitting element and the power supply body. The power supply body has a terminal holding portion formed of an insulating resin material, and a connection terminal supported by the terminal holding portion and connected to an external power supply. The connection terminal and the electrode pad are connected to each other by a conduction connecting part.

In this way, in the light source unit, the connection terminal of the power supply body is positioned outside the substrate. Therefore, the heat-dissipation area of the substrate can be increased.

As a seventh aspect, another vehicle lamp according to the present invention is a vehicle lamp including a light source unit. The light source unit includes a light emitting element that functions as a light source, a wiring pattern on which the light emitting element is mounted, an electrode pad connected to the wiring pattern, a substrate on which the wiring pattern is formed and the electrode pad is mounted, a power supply body that supplies external power to the electrode pad, and a socket housing which has an engaging portion engaged with a predetermined member and holds the substrate, the light emitting element and the power supply body. A placement recess in which the substrate is placed is formed in the socket housing, a part of the connection terminal to be connected to a power supply circuit is positioned in the portion of the placement recess between the substrate and the engaging portion, and the connection erminal and the electrode pad are connected to each other by a conduction connecting part.

In this way, since the connection terminal of the power supply body is positioned in the portion of the placement recess of the light source unit outside the substrate, the heat-dissipation area of the substrate can be increased.

Effects of Invention

According to the present invention, since the connection terminal of the power supply body is positioned outside the substrate, the heat-dissipation area of the substrate can be increased, and hence, the heat-dissipation properties at the time of emitting light from the light emitting element can be improved.

EMBODIMENTS OF INVENTION

Hereinafter, embodiments for carrying out the present invention will be described with reference to the accompanying drawings.

In the embodiments described below, a light source unit of the present invention is applied to a light source unit used for a combination lamp having a function of a stop lamp and a tail lamp, and a vehicle lamp of the present invention is applied to a vehicle lamp including the light source unit. However, it should be noted that the scope of the present invention is not limited to the light source unit used for the combination lamp having the function of the stop lamp and the tail lamp, and the vehicle lamp including the light source unit.

A light source unit of the present invention can be widely applied to a light source unit which is used for various vehicle lamps such as a headlamp, a clearance lamp, a tail lamp, a turn signal lamp, a stop lamp, a day time running lamp, a cornering lamp, a hazard lamp, a position lamp, a back lamp, a fog lamp, or a combination lamp thereof. Further, a vehicle lamp of the present invention can be widely applied to a vehicle lamp including these various light source units.

In the following description, a front and rear direction, an up and down direction and a right and left direction are defined in such a manner that an optical axis direction is set as the front and rear direction, and an emission direction of light is set as the rear side. Meanwhile, the front and rear direction, the up and down direction and the right and left direction, which are described below, are defined for convenience of explanation. The practice of the present invention is not limited to these directions.

Figure 1:
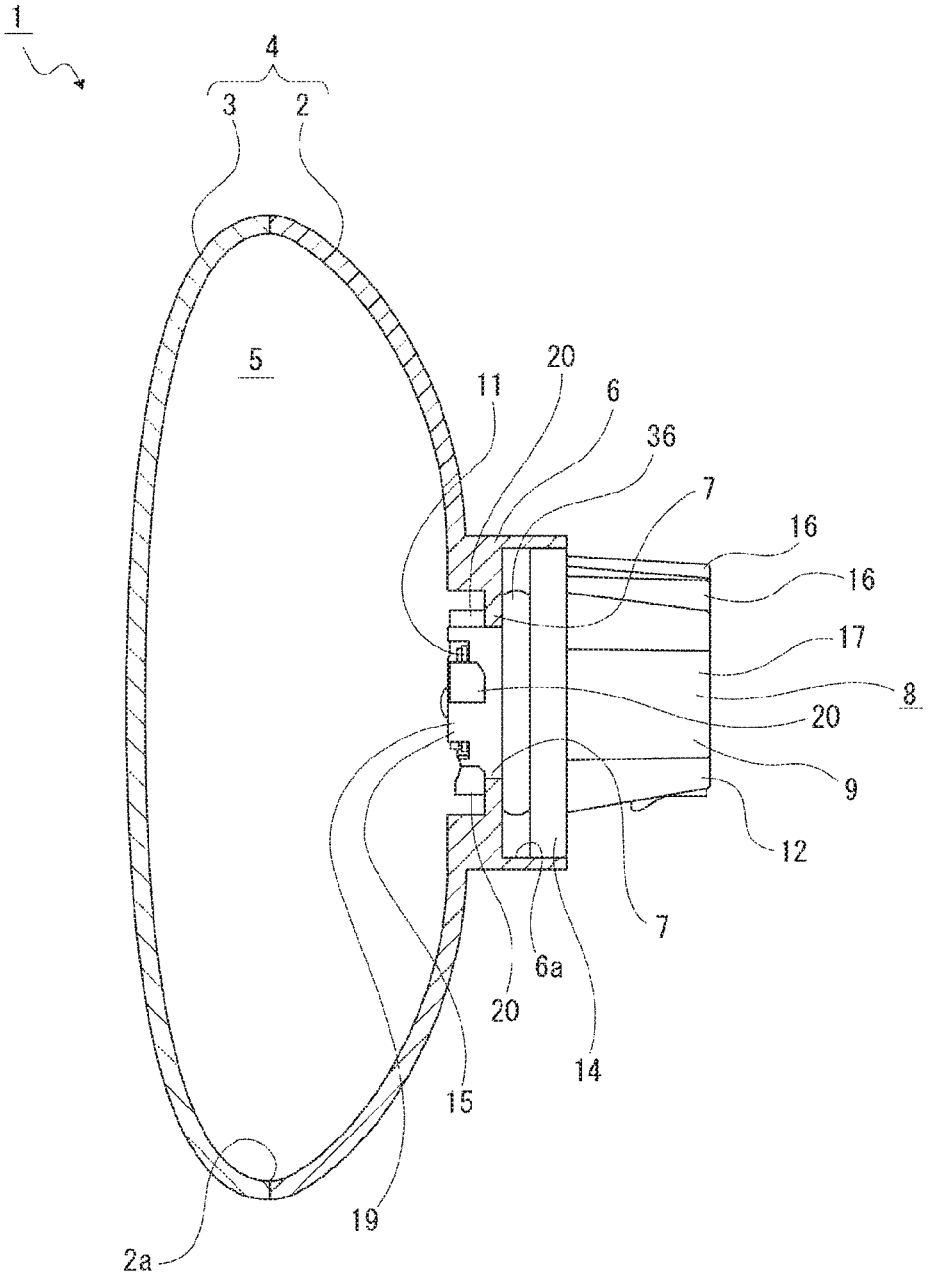
FIG. 1 is a sectional view of a vehicle lamp, showing an embodiment of the present invention together with FIGS. 2 to 16.

First, a schematic configuration of a vehicle lamp is described (see FIG. 1).

A vehicle lamp 1 is respectively attached and arranged at both left and right ends of the front end portion of a vehicle body.

The vehicle lamp 1 includes a lamp body 2 having a recess opened rearward and a cover 3 closing a rear opening 2*a* of the lamp body 2. A lamp outer housing 4 is configured by the lamp body 2 and the cover 3. An inner space of the lamp outer housing 4 is formed as a lamp chamber 5.

A front end portion of the lamp body 2 is provided as a substantially cylindrical unit mounting portion 6 that penetrates in the front and rear direction. An internal space of the unit mounting portion 6 is formed as a mounting hole 6*a*. At an inner peripheral surface of the unit mounting portion 6, engaging protrusions 7, 7, . . . protruding inwardly are provided so as to be spaced apart from each other in a circumferential direction.

Subsequently, a structure of a light source unit 8, which is attached to the lamp body 2, is described (see FIGS. 2 to 6).

The light source unit 8 is detachably attached to the unit mounting portion 6 of the lamp body 2. The light source unit 8 includes a socket housing 9, a power supply body 10, and a light emitting module 11 (see FIGS. 2 to 6).

The socket housing 9 is formed by integrally molding a resin-molded part 12 and a heat-dissipation plate 13. As the integral molding, for example, a so-called insert molding is used in which a molten resin (resin material) is filled in a state where a metallic material is retained in a cavity of a mold, and a molded product is integrally formed by the metallic material and the resin material.

The resin-molded part 12 has excellent thermal conductivity and is formed of, for example, a resin material which contains carbon or the like. The resin-molded part 12 also has conductivity. It is preferable that a heat conduction coefficient of the resin-molded part 12 is in a range of 1 W/(mK) to 30 W/(mK), and the thermal conductivity thereof is lower than that of the heat-dissipation plate 13 and higher than that of a terminal holding portion (21) (to be described later). The resin-molded part 12 has a disc-shaped base surface portion 14 oriented in the front and rear direction, a protrusion-shaped portion 15 protruding rearward from the center of the base surface portion 14, first heat-dissipation fins 16, 16, . . . protruding forward from the base surface portion 14, second heat-dissipation fins 17, 17 protruding forward from the base surface portion 14, and a connector connection portion 18 protruding forward from the base surface portion 14.

The protrusion-shaped portion 15 includes a substrate placement portion 19 having a circular outer shape and engaging portions 20, 20, . . . provided on an outer peripheral surface of the substrate placement portion 19.

The substrate placement portion 19 is formed with a placement recess 19*a* opening rearward. The placement recess 19*a* has a substantially rectangular shape and is slightly greater than an outer shape of the light emitting module 11. The engaging portions 20, 20, . . . are provided so as to be spaced apart from each other in the circumferential direction. The engaging portions 20, 20, . . . are located at a rear end portion of the substrate placement portion 19.

Figure 6:
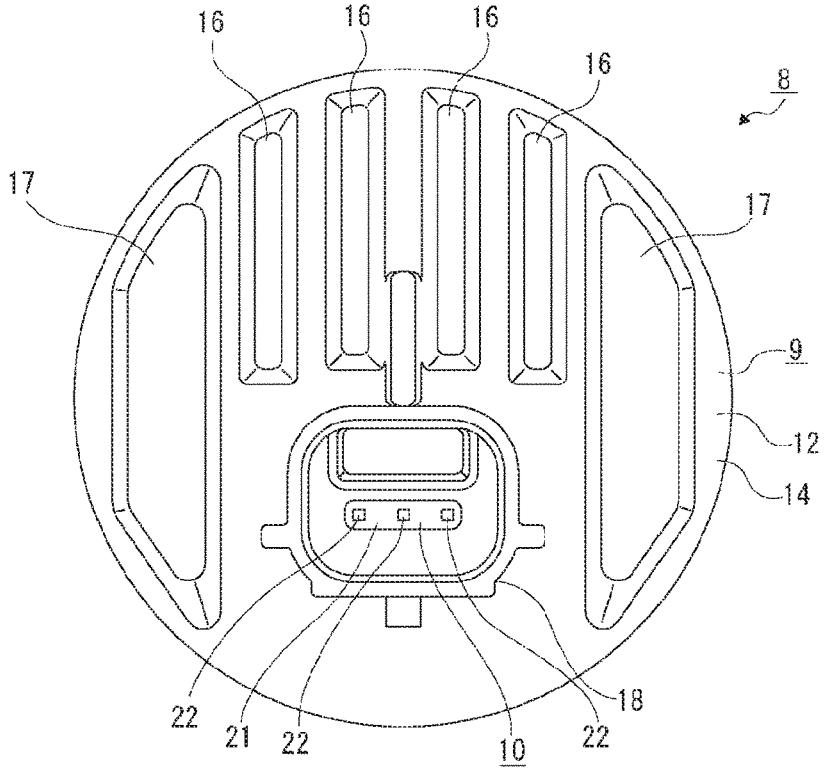
FIG. 6 is a rear view of the light source unit.

The first heat-dissipation fins 16, 16, . . . are provided side by side at equal intervals in the right and left direction, for example, and protrude from an upper half in the portion other than both left and right ends of the base surface portion 14 (see FIG. 6).

The second heat-dissipation fins 17, 17 are respectively disposed at both sides of the first heat-dissipation fins 16, 16, . . . in the right and left direction and protrude from both left and right ends of the base surface portion 14. A thickness in the right and left direction of the second heat-dissipation fins 17, 17 is thicker than a thickness in the right and left direction of the first heat-dissipation fins 16, 16, . . . .

The connector connection portion 18 has a cylindrical shape whose axial direction is the front and rear direction, and is disposed below the first heat-dissipation fin 16, 16, . . . .

Figure 2:
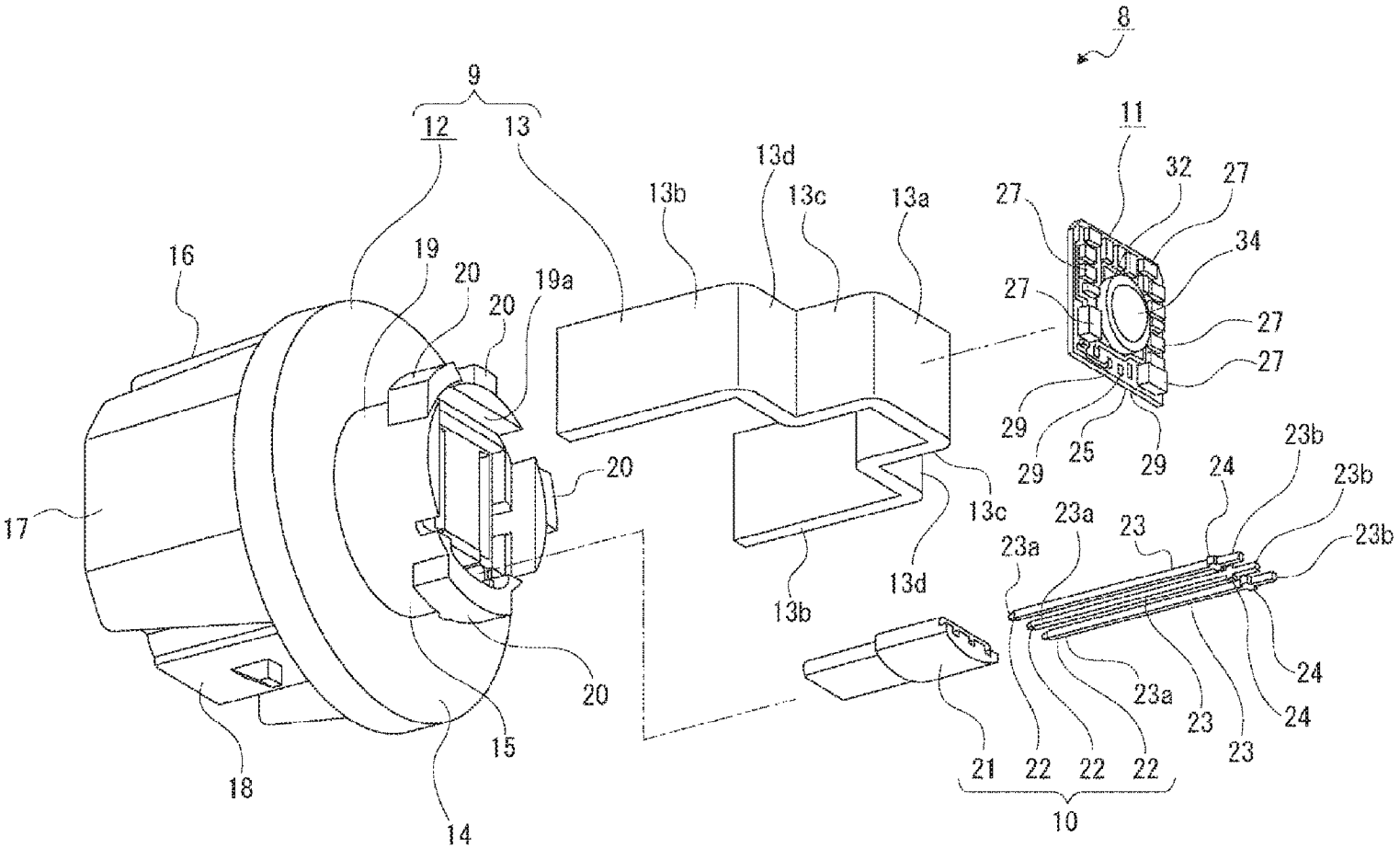
FIG. 2 is an exploded perspective view of a light source unit.
Figure 4:
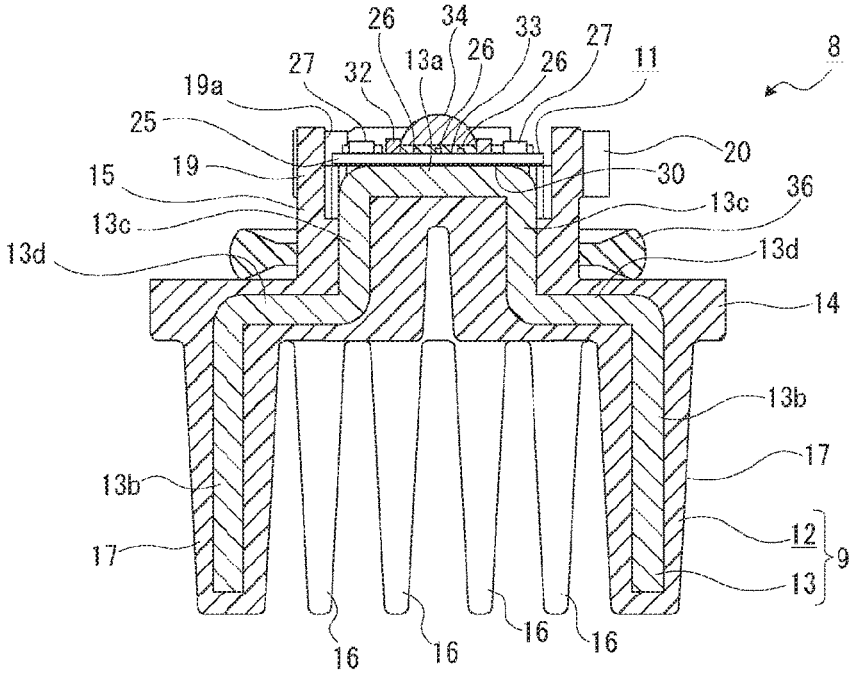
FIG. 4 is a sectional view of the light source unit.
Figure 5:
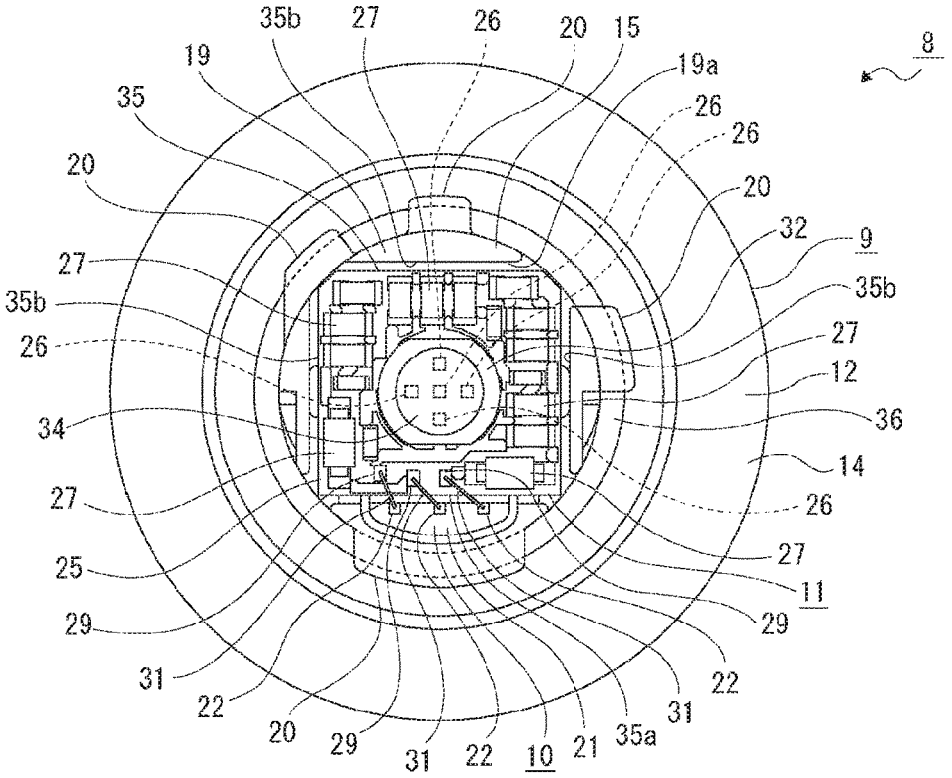
FIG. 5 is a front view of the light source unit.

The heat-dissipation plate 13 is formed in a predetermined shape by a plate-like metallic material such as aluminum having high thermal conductivity (see FIGS. 2 and 4). The heat-dissipation plate 13 includes a first heat-dissipation portion 13*a*, second heat-dissipation portions 13*b*, 13*b*, third heat-dissipation portions 13*c*, 13*c*, and fourth heat-dissipation portions 13*d*, 13*d*.

The first heat-dissipation portion 13*a* and the fourth heat-dissipation portions 13*d*, 13*d* are respectively formed in a substantially rectangular shape oriented in the front and rear direction. The second heat-dissipation portions 13*h*, 13*b* and the third heat-dissipation portions 13*c*, 13*c* are respectively formed in a substantially rectangular shape oriented in the right and left direction. Rear ends of the third heat-dissipation portions 13*c*, 13*c* are respectively continuous with both left and right ends of the first heat-dissipation portion 13*a*. Inner ends of the fourth heat-dissipation portions 13*d*, 13*d* are respectively continuous with front ends of the third heat-dissipation portions 13*c*, 13*c*, and outer ends thereof are respectively continuous with rear ends of the second heat-dissipation portions 13*b*, 13*b*. Therefore, the third heat-dissipation portions 13*c*, 13*c* are respectively formed by being bent in a direction perpendicular to the first heat-dissipation portion 13*a*. The fourth heat-dissipation portions 13*d*, 13*d* are respectively formed by being bent in a direction perpendicular to the third heat-dissipation portions 13*c*, 13*c*. The second heat-dissipation portions 13*b*, 13*b* are respectively formed by being bent in a direction perpendicular to the fourth heat-dissipation portions 13*d*, 13*d*.

The heat-dissipation plate 13 is configured such that the first heat-dissipation portion 13*a* is disposed in the placement recess 19*a* of the substrate placement portion 19 of the resin-molded part 12 and is exposed to the resin-molded part 12 (see FIG. 4). The heat-dissipation plate 13 is configured such that the second heat-dissipation portions 13*b*, 13*b* are respectively disposed on the inside of the second heat-dissipation fins 17, 17, the third heat-dissipation portions 13*c*, 13*c* are disposed on the inside of the substrate placement portion 19, and the fourth heat-dissipation portions 13*d*, 13*d* are disposed on the inside of the base surface portion 14.

An insertion and placement hole (not shown) is formed at a position up to the base surface portion 14 from the substrate placement portion 19 of the resin-molded part 12. The insertion and placement hole communicates with the interior of the placement recess 19*a* and the connector coupling portion 18.

The power supply body 10 includes a terminal holding portion 21 formed of an insulating resin material, and connection terminals 22, 22, 22 which are held in the terminal holding portion 21 and connected to a power supply circuit (external power; not shown) (see FIG. 2).

The terminal holding portion 21 has a flat shape which extends in the front and rear direction and has a thin thickness in the up and down direction.

The connection terminals 22, 22, 22 are for lied of a metallic material and disposed side by side in the right and left direction in the interior of the terminal holding portion 21 except for a part thereof. Each connection terminal 22 has a terminal portion 23 extending in the front and rear direction, and retaining protrusions 24, 24 protruding in opposite directions from a rear end position of the terminal portion 23. A front end portion of each terminal portion 23 is provided as a connector connection portion 23*a*, and a rear end portion thereof is provided as a wire connection portion 23*b*. At least a portion of the surface of the wire connection portion 23*b* is subjected to surface treatment by nickel or gold or the like, for example.

Each connection terminal 22 is configured such that the connector connection portion 23*a* protrudes forward from the terminal holding portion 21 and the wire connection portion 23*b* protrudes rearward from the terminal holding portion 21. Since the retaining protrusions 24, 24 are positioned at the inside of the terminal holding portion 21, the connection terminal 22 is prevented from being detached from the terminal holding portion 21 in the front and rear direction.

The power supply body 10 is integrally formed by an insert molding of the terminal holding portion 21 and the connection terminals 22, 22, 22, for example. The power supply body 10 is configured such that the portion other than the connector connection portions 23*a*, 23*a*, 23*a* and the wire connection portions 23*b*, 23*b*, 23*b* is inserted into the insertion and placement hole formed in the resin-molded part 12, the connector connection portions 23*a*, 23*a*, 23*a* are disposed at the inside of the connector connection portion 18 (see FIG. 6), and the wire connection portions 23*b*, 23*b*, 23*b* are disposed in the placement recess 19*a* (see FIG. 3).

For example, in the state of being formed by an insert molding, the power supply body 10 is positioned in a cavity of a mold, molten resin for forming the resin-molded part 12 is filled into the cavity, and the power supply body 10 is formed integrally with the socket housing 9 by an insert molding, for example.

In this manner, the power supply body 10 is formed by integrally molding the terminal holding portion 21 and the connection terminals 22, 22, 22, and the power supply body 10 and the socket housing 9 are coupled by being integrally molded.

Therefore, the power supply body 10 is foiiEied by the integral molding, and then, the power supply body 10 and the socket housing 9 are integrally molded, so that good positional accuracy of the connection terminals 22, 22, 22 to the terminal holding portion 21 and good positional accuracy of the power supply body 10 to the socket housing 9 can be ensured. Further, an operation of coupling the power supply body 10 and the socket housing 9 is not necessary, so that workability can be improved.

The light emitting module 11 includes a substrate 25 having a substantially rectangular shape oriented in the front and rear direction, light emitting elements 26, 26, . . . mounted on the substrate 25, and various control elements 27, 27, . . . mounted on the substrate 25 (see FIGS. 2 to 5).

The substrate 25 is, for example, a ceramic substrate. A wiring pattern for supplying current to the light emitting elements 26, 26, . . . is formed in the substrate 25. The size of the substrate 25 is slightly larger than that of the first heat-dissipation portion 13*a* of the heat-dissipation plate 13.

Figure 7:
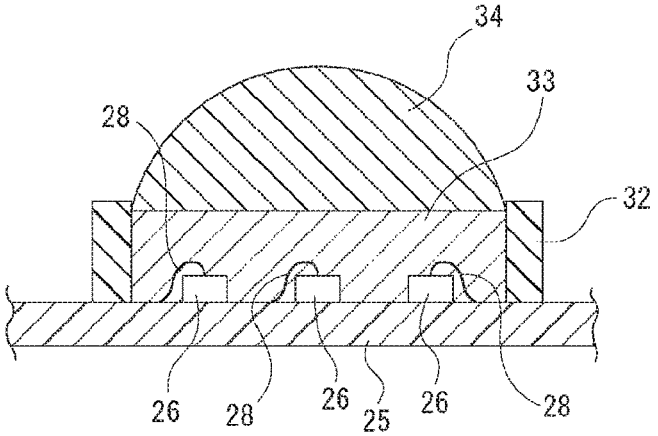
FIG. 7 is a schematic enlarged sectional view showing a state where a lens part is disposed on a sealing part which seals a light emitting element and a conductive wire.

For example, five light emitting elements 26, 26, . . . are mounted on the center of the substrate 25. Light emitting diodes (LEDs) are used as the light emitting elements 26, 26, . . . . The light emitting elements 26, 26, . . . are configured such that four light emitting elements 26, 26, . . . are mounted around one light emitting element 26 in the state of being spaced apart from each other at equal intervals in the circumferential direction. The center light emitting element 26 serves as a light source for a tail lamp, for example, and four surrounding light emitting elements 26, 26, . . . serve as a light source for a stop lamp, for example. The light emitting elements 26, 26, . . . are respectively connected to the wiring patterns by conductive wires 28, 28, . . . (see FIG. 7).

The connection terminals 22, 22, 22 are provided as a power supply terminal for a tail lamp, a power supply terminal for a stop lamp, and a power supply terminal for an earth, respectively.

Further, the number and function of the light emitting element 26 mounted on the substrate 25 can be arbitrarily set, depending on the type and the required brightness or the like of the vehicle lamp 1.

For example, diodes, capacitors or resistors or the like are used as the control elements 27, 27, . . . . The control elements 27, 27, . . . are mounted at positions of the light emitting module 11 on the outside of the light emitting elements 26, 26, . . . and are connected to the wiring patterns, respectively.

A rear surface of the substrate 25 is adhered to the surface of the first heat-dissipation portion 13*a* of the heat-dissipation plate 13 by an adhesive 30 (see FIG. 4). A thermally conductive adhesive is used as the adhesive 30.

Figure 3:
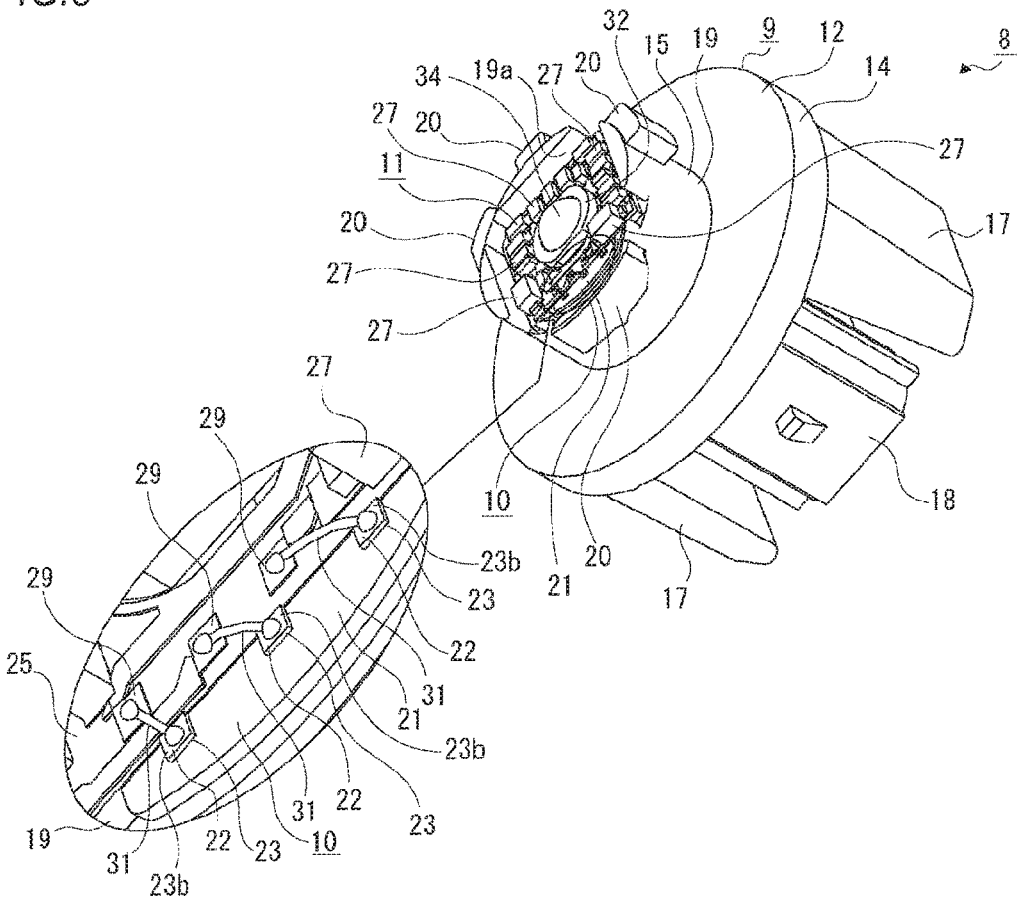
FIG. 3 is a perspective view of the light source unit.

At a lower end portion of the substrate 25, electrode pads 29, 29, 29 connected to the wiring patterns are formed side by side in the right and left direction (see FIG. 3).

The electrode pads 29, 29, 29 are located in the vicinity of the wire connection portions 23*b*, 23*b*, 23*b* of the connection terminals 22, 22, 22, respectively.

For example, the electrode pads 29, 29, 29 are respectively connected, through ultrasonic welding or soldering, to the wire connection portions 23*b*, 23*b*, 23*b* of the connection terminals 22, 22, 22 by wires 31, 31, 31 formed of aluminum or the like and serving as a conduction connecting part. The connection between the wire connection portion 23*b* and the wire 31 is performed at the portion of the wire connection portion 23*b*, which is subjected to the surface treatment by nickel or gold or the like. Meanwhile, the connection between the electrode pads 29, 29, 29 and the connection terminals 22, 22, 22 may be performed by a conduction connecting part other than the wires 31, 31, 31.

Figure 8:
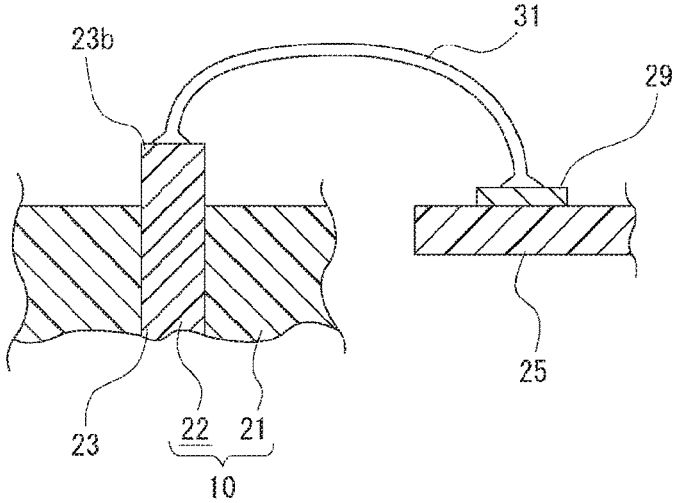
FIG. 8 is a schematic enlarged sectional view showing a state where an electrode pad and a connection terminal having a terminal portion linearly formed are connected to each other by a wire.
Figure 9:
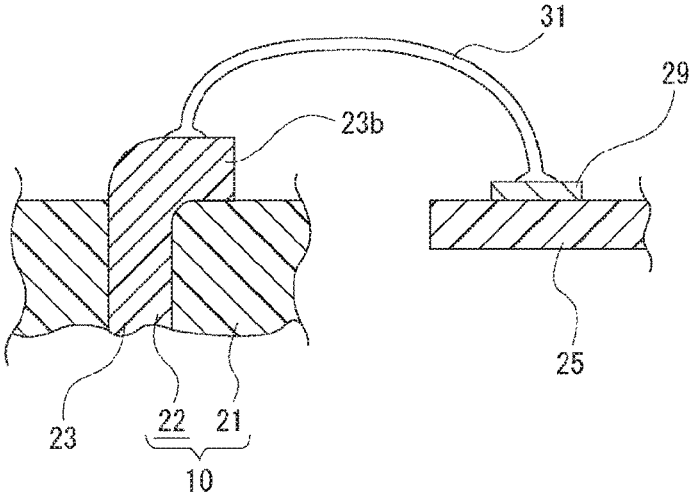
FIG. 9 is a schematic enlarged sectional view showing a state where an electrode pad and a connection terminal having a terminal portion bent are connected to each other by a wire.

Further, as shown in FIG. 8, the connection terminal 22 may be configured such that the terminal portion 23 is linearly formed and a rear end surface of the terminal portion 23 is joined to the wire 31, or, as shown in FIG. 9, the connection terminal 22 may be configured such that a rear end portion of the terminal portion 23 is bent by 90° and a peripheral surface of the terminal portion 23 is joined to the wire 31.

A frame body 32 is attached to the portion of the substrate 25 between the light emitting elements 26, 26, . . . and the control elements 27, 27, . . . (see FIGS. 3, 4 and 7). The frame body 32 is formed in a substantially annular shape by a resin material. The frame body 32 is disposed at a position to surround the light emitting elements 26, 26, . . . and the conductive wires 28, 28, . . . .

A sealing part 33 is applied inside the frame body 32. The light emitting elements 26, 26, . . . and the conductive wires 28, 28, . . . are sealed by the sealing part 33 (see FIG. 7). The sealing part 33 is formed in such a way that liquid sealing resin is filled (injected) into the frame body 32 and then cured. In this way, the sealing part 33 seals the light emitting elements 26, 26, . . . and the conductive wires 28, 28, . . . . Therefore, the frame body 32 has a function of determining the sealing part 33 into a predetermined shape by preventing the seal sin from unnecessarily flowing toward the control elements 27, 27, . . . .

The refractive index of the sealing part 33 has an intermediate value of the refractive index of the light emitting elements 26, 26, . . . and the refractive index of air. Since the light emitting elements 26, 26, . . . are sealed by the sealing part 33, a difference between the refractive index of the light emitting elements 26, 26, . . . and the refractive index of air is alleviated. Therefore, the emission efficiency of light from the light emitting elements 26, 26, . . . to the outside is improved.

A lens part 34 is disposed on the sealing part 33. The lens part 34 is formed of a predetermined molding resin and has a hemispherical shape which is convex rearward. The lens part 34 is formed in such a rummer that, for example, predetermined liquid molding resin is filled and cured on the sealing part 33 before curing or after curing on the inside of the frame body 32. Therefore, the frame body 32 also has a function of determining the lens part 34 into a predetermined shape by preventing the molding resin for forming the lens part 34 from unnecessarily flowing toward the control elements 27, 27, . . . .

The lens part 34 is for ued in such a manner that the molding resin is filled and cured on the sealing part 33. Therefore, the frame body 32 also has a function of determining the lens part 34 into a predetermined shape by preventing the molding resin for forming the lens part 34 front unnecessarily flowing toward the control elements 27, 27, . . . .

Further, the refractive index of the lens part 34 has an intermediate value of the refractive index of the light emitting element 26 and the refractive index of air. Since the light emitted from the light emitting elements 26, 26, . . . is less likely to be totally reflected at the interface of the sealing part 33 and the lens part 34, it is possible to improve the emission efficiency of light from the light emitting elements 26, 26, . . . to the outside.

Furthermore, since the frame body 32 is provided, the sealing resin or molding resin is formed in a certain shape even in the case where the injection position of the sealing resin or molding resin is deviated from a predetermined position when the sealing resin or molding resin is injected to the inside of the frame body 32. Therefore, it is possible to improve the molding accuracy of the sealing resin or molding resin.

The molding resin has viscosity higher than that of the sealing resin and has flowability lower than that of the sealing resin. The viscosity of the molding resin is equal to or greater than 40 Pa·s (pascal·second), for example, and the viscosity of the sealing resin is in the range of 5 to 15 Pa·s (pascal·second), for example.

When the viscosity of the molding resin is set to be equal to or greater than 40 Pa·s, the molding resin does not flow more than necessary at the time of being injected onto the sealing resin. Therefore, the shape of the lens part 34 is likely to be formed in a desired shape.

On the other hand, when the viscosity of the sealing resin is set to the range of 5 to 15 Pa·s, the sealing resin is flowing in a desired state at the time of being injected onto the substrate 25. Therefore, it is easy to maintain a planar shape and it is possible to secure good formability. Further, when the viscosity of the sealing resin is set to the range of 5 to 15 Pa·s, the load on the conductive wires 28, 28, . . . becomes small when the sealing resin is injected onto the substrate 25. Therefore, it is possible to suppress the occurrence of disconnection or the like of the conductive wires 28, 28, . . . .

Meanwhile, when the sealing resin is injected onto the substrate 25, the sealing resin is injected to the inside of the frame body 32 and the shape of the sealing resin (the sealing part 33) is determined by the frame body 32. Therefore, the viscosity of the sealing resin may be less than 5 Pa·s.

Further, there is a case that the lens part 34 is formed by a mold and then disposed on the sealing part 33. However, in this case, since the lens part 34 is formed into a predetermined shape by the mold, the molding resin having viscosity less than 40 Pa·s may be used. Meanwhile, at room temperature (25° C.), the lens part (after curing) 34 has a higher elastic modulus than the sealing part 33 (after curing). Preferably, the elastic modulus of the sealing part 33 is less than 1 MPa and the elastic modulus of the lens part 34 is equal to or greater than 1 Mpa.

In the state where the lens part 34 is disposed, the light emitting elements 26, 26, . . . and the conductive wires 28, 28, . . . are covered by the lens part 34 in a state of being sealed by the sealing part 33.

Meanwhile, an example where the frame body 32 is formed of a resin material has been illustrated in the above description. However, the frame body 32 may be formed of a metallic material. Further, the frame body 32 may be formed of a resin material and the surface thereof may be subjected to processing such as metal deposition. Furthermore, the frame body 32 may be formed of a white resin. By configuring the frame body 32 in this structure, the frame body 32 can serve as a reflector to reflect a portion of light emitted from the light emitting elements 26, 26, . . . .

An annular gasket 36 formed of, for example, a rubber material or a resin material is externally fitted and attached to the protrusion-shaped portion 15 of the light source unit 8 configured as described above (see FIGS. 1 and 4). The gasket 36 is formed of a resin material or a rubber material. In the state where the gasket 36 is attached to the light source unit 8, the protrusion-shaped portion 15 is inserted to the unit mounting portion 6 of the lamp body 2 from the front and is rotated in the circumferential direction. In this way, the engaging portions 20, 20, . . . are respectively engaged with the engaging protrusions 7, 7, . . . from the rear (see FIG. 1). At this time, the engaging protrusions 7, 7, . . . are clamped in the engaging portions 20, 20, . . . and the gasket 36, and hence, the light source unit 8 is attached to the lamp body 2. in the state where the light source unit 8 is attached to the lamp body 2, the unit mounting portion 6 is closed by the gasket, and hence, foreign matters such as moisture are prevented from entering the lamp chamber 5 through the unit mounting portion 6 from the outside.

On the contrary, when the light source unit 8 is rotated in a direction opposite to the above direction along the circumferential direction, the engagement of the engaging portions 20, 20, . . . to the engaging protrusions 7, 7, . . . is released, and hence, the protrusion-shaped portion 15 can be pulled from the unit mounting portion 6. In this way, the light source unit 8 can be detached from the lamp body 2.

When current is supplied to the wiring pattern through the connection terminals 22, 22, 22 from the power supply circuit in the state where the light source unit 8 is attached to the lamp body 2, light is emitted from at least one light emitting element 26. At this time, when the vehicle lamp 1 serves as a tail lamp, light is emitted from one light emitting element 26 located at the center. Further, when the vehicle lamp 1 serves as a stop lamp, light is emitted from four light emitting elements 26, 26, . . . other than the one located at the center.

The light emitted from the light emitting element 26 is transmitted through the sealing part 33 and the lens part 34, and is irradiated to the outside through the cover 3. At this time, the irradiation direction of the light is controlled by the lens part 34, so that the light is irradiated to the outside toward a predetermined direction. At this time, when the frame body 32 serves as a reflector, a portion of the light emitted from the light emitting element 26 is irradiated to the outside by being reflected in the frame body 32.

At the time of emitting light from the light emitting element 26, heat is generated in the light emitting module 11. However, the heat generated is transmitted to the first heat-dissipation portion 13*a* through the adhesive 30 having excellent thermal conductivity, and is transmitted to the heat-dissipation plate 13 and the resin-molded part 12. The heat, which is transmitted to the heat-dissipation plate 13 and the resin-molded part 12, is mainly dissipated to the outside from the first heat-dissipation fins 16, 16, . . . and the second heat-dissipation fins 17, 17.

As described above, in the light source unit 8, the electrode pads 29, 29, 29 are provided in the light emitting module 11, the power supply body 10 is disposed outside the light emitting module 11, and the electrode pads 29, 29, 29 and the connection terminals 22, 22, 22 are connected to each other by the wires 31, 31, 31, respectively.

In such a configuration, for example, the electrode pads 29, 29, 29, the connection terminals 22, 22, 22, and the wires 31, 31, 31 may be sealed with resin.

As the wires 31, 31, 31 are sealed with the resin, for example, when the light source unit 8 is attached to or detached from the lamp body 2, fingers or the like are not inadvertently brought into contact with the wires 31, 31, 31. Therefore, the disconnection of the wires 31, 31, 31 or the detachment of the wires 31, 31, 31 from the electrode pads 29, 29, 29 and the connection terminals 22, 22, 22 can be prevented.

Further, as described above, the placement recess 19*a* formed in the substrate placement portion 19 of the socket housing 9 is slightly larger than the outer shape of the substrate 25 of the light emitting module 11. Therefore, in the state where the light emitting module 11 is disposed in the placement recess 19*a*, a gap 35 is formed between an outer peripheral surface of the substrate 25 and an inner peripheral surface of the placement recess 19*a* (see FIG. 5). As described above, the size of the substrate 25 is slightly larger than that of the first heat-dissipation portion 13*a* of the heat-dissipation plate 13. Therefore, when the substrate 25 is attached to the first heat-dissipation portion 13*a* of the heat-dissipation plate 13 by the adhesive 30, a part of the adhesive 30 is protruded to the outer peripheral side of the first heat-dissipation portion 13*a* and the protruded adhesive 30 is filled in the gap 35.

Figure 10:
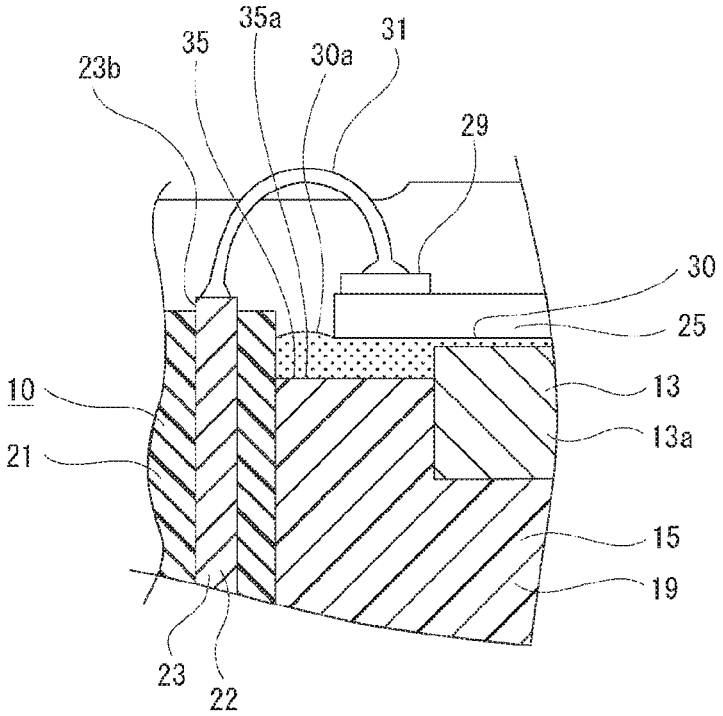
FIG. 10 is an enlarged sectional view showing a shallow groove portion in a gap formed between an outer peripheral surface of the substrate and an inner peripheral surface of a placement recess.
Figure 11:
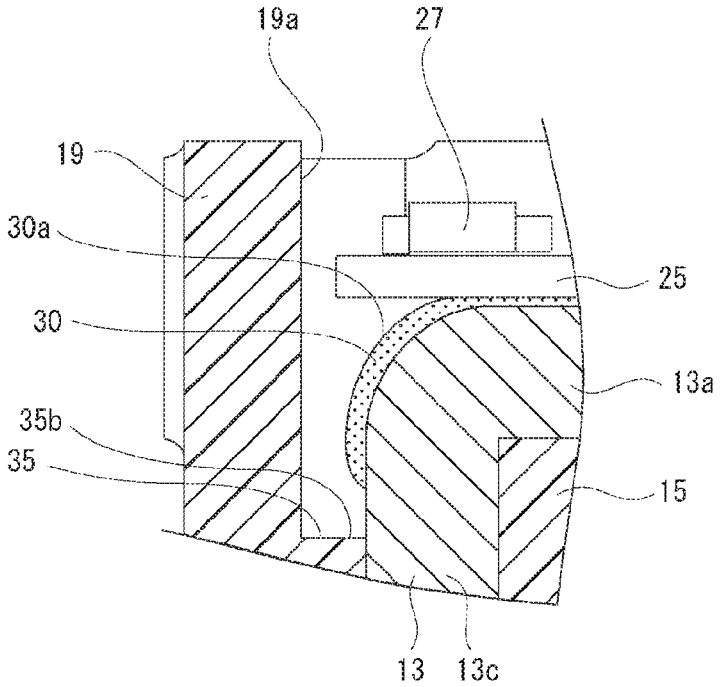
FIG. 11 is an enlarged sectional view showing a deep groove portion in the gap formed between the outer peripheral surface of the substrate and the inner peripheral surface of the placement recess.

The gap 35 is configured such that, out of the four linear groove portions around the substrate 25, one linear portion positioned on the front side of the wires 31, 31, 31 is formed as a shallow groove portion 35*a* (see FIG. 10) and the other thee linear portions are formed as deep groove portion 35*b*, 35*b*, 35*b*, respectively (see FIG. 11). The shallow groove portion 35*a* is shallower than the deep groove portions 35*b*, 35*b*, 35*b*, and the bottom surface forming the shallow groove portion 35*a* is provided to have substantially the same height as a surface of the first heat-dissipation portion 13*a*. Therefore, a surface 30*a* of the adhesive 30 protruding when attaching the substrate 25 to the first heat-dissipation portion 13*a* is present at a position closer to the substrate 25 in the shallow groove portion 35*a* than the deep groove portion 35*b* (see FIGS. 10 and 11).

In this manner, the portion of the gap 35 positioned on the front side of the wires 31, 31, 31 is formed as the shallow groove portion 35*a* and, in the shallow groove portion 35*a*, the portion of the rear surface (front surface) of the substrate 25 is filled with the adhesive 30. Therefore, when the wires 31, 31, 31 are connected to the electrode pads 29, 29, 29 by ultrasonic bonding, appropriate ultrasonic wave can be propagated to a bonding portion between the wires 31, 31, 31 and the electrode pads 29, 29, 29. Thus, a sufficient amount of ultrasonic wave is propagated to the bonding portions between the wires 31, 31, 31 and the electrode pads 29, 29, 29. A strong bonding state of the wires 31, 31, 31 to the electrode pads 29, 29, 29 can be ensured.

Figure 12:
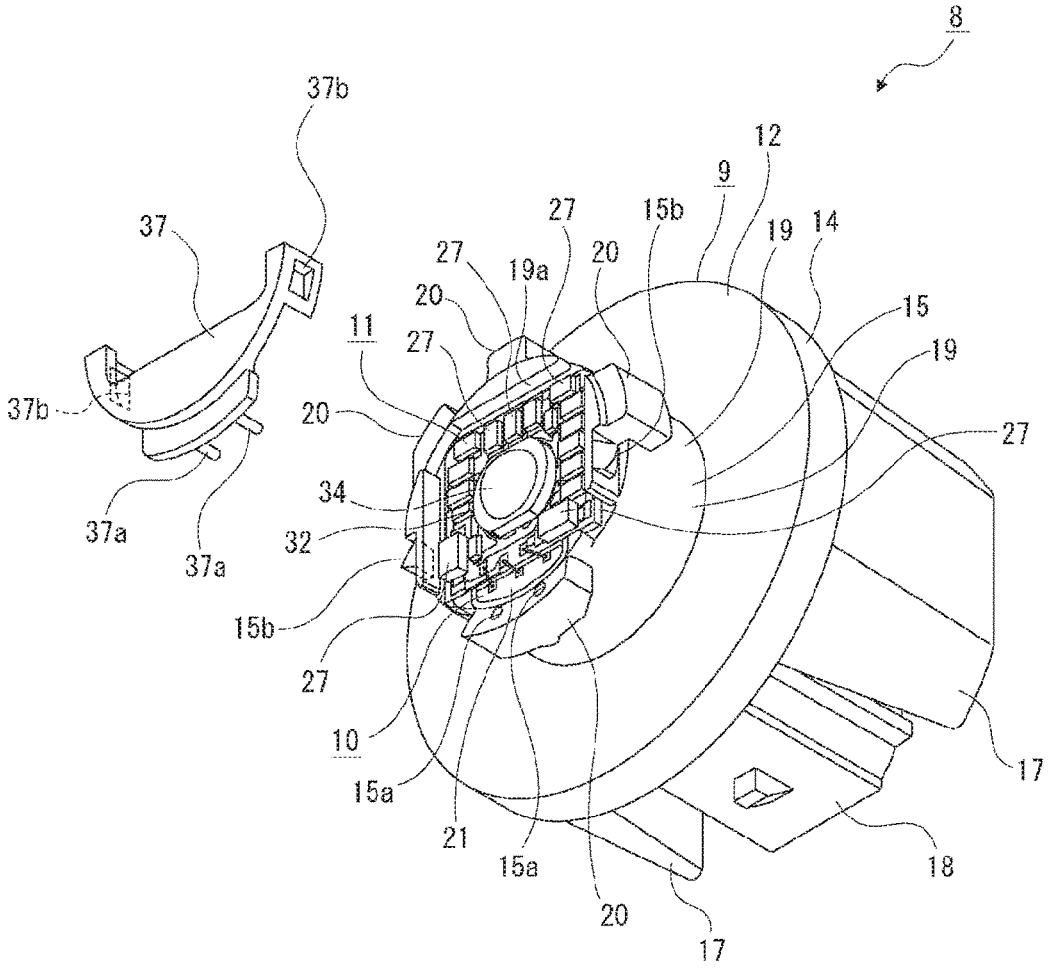
FIG. 12 is a perspective view showing a state where the light source unit and a shielding member are separated.

Furthermore, the electrode pads 29, 29, 29, the connection terminals 22, 22, 22 and the wires 31, 31, 31 may be configured to be covered by a shielding member 37 (see FIG. 12). When the shielding member 37 is used, positioning holes 15*a*, 15*a* are formed and locking protrusions 15*b*, 15*b* are provided in the protrusion-shaped portion 15 of the socket housing 9, for example. In the shielding member 37, positioning pins 37*a*, 37*a* are provided and locking hole 37*b*, 37*b* are formed.

The shielding member 37 is attached to the socket housing in such a manner that the positioning pins 37*a*, 37*a* are positioned relative to the socket housing 9 by being respectively inserted through the positioning holes 15*a*, 15*a* and the locking protrusions 15*b*, 15*b* are respectively locked to the locking holes 37*b*, 37*b*.

In this way, the shielding member 37 shielding at least the wires 31, 31, 31 is provided and the positioning pins 37*a*, 37*a* are respectively inserted through the positioning holes 15*a*, 15*a*, so that the shielding member 37 is attached to the socket housing 9.

Therefore, the wires 31, 31, 31 are reliably shielded by the shielding member 37 and, for example, when the light source unit 8 is attached to or detached from the lamp body 2, fingers or the like are not inadvertently brought into contact with the wires 31, 31, 31, so that the disconnection of the wires 31, 31, 31 or the detachment of the wires 31, 31, 31 from the electrode pads 29, 29, 29 and the connection terminals 22, 22, 22 can be prevented.

Further, for example, the shielding member 37 may be formed in a shape or size allowing it to serve as a shade for shielding a part of light emitted from the light emitting elements 26, 26, . . . . As the shielding member 37 is also used as the shade, the functionality of the light source unit 8 can be improved and a desired light distribution pattern can be formed without increasing the number of parts.

In the light source unit 8, the power supply body 10 includes the terminal holding portion 21 formed of an insulating resin material, and the connection terminals 22, 22, 22 held in the terminal holding portion 21. The power supply body 10 is connected to the socket housing 9, and the connection terminals 22, 22, 22 and the electrode pads 29, 29, 29 provided in the light emitting module 11 are connected to each other by the wires 31, 31, 31.

Therefore, there is no need to provide a space for inserting the connection terminals 22, 22, 22 in the light emitting module 11. Further, since the connection terminals 22, 22, 22 are positioned outside the light emitting module 11, the connection terminals 22, 22, 22 do not interfere with the first heat-dissipation portion 13*a* of the heat-dissipation plate 13, and thus, the contact area between the substrate 25 and the heat-dissipation plate 13 can be increased, thereby increasing the heat-dissipation area. As a result, the heat-dissipation properties at the time of emitting light from the light emitting elements 26, 26, . . . can be improved.

Further, one end portions of the connection terminals 22, 22, 22 of the power supply body 10 are located adjacent to the substrate 25, and at least the portions of the power supply body 10 excluding both end portions are located inside the socket housing 9.

Therefore, since the lengths of the wires 31, 31, 31 are shortened, and the power supply body 10 is located so as not to protrude largely from the socket housing 9, the manufacturing cost of the light source unit 8 can be reduced and the size thereof can be reduced.

Furthermore, the placement recess 19*a* in which the light emitting module 11 is placed is formed in the socket housing 9. The wire connecting portions 23*b*, 23*b*, 23*b* of the connection terminals 22, 22, 22 are positioned at the portions of the placement recess 19*a* between the light emitting module 11 and the engaging portion 20. The connection terminals 22, 22, 22 and the electrode pads 29, 29, 29 are connected to each other by the wires 31, 31, 31.

Therefore, since the connection terminals 22, 22, 22 do not interfere with the first heat-dissipation portion 13*a* of the heat-dissipation plate 13, the contact area between the substrate 25 and the heat-dissipation plate 13 can be increased, thereby increasing the heat-dissipation area. As a result, the heat-dissipation properties at the time of emitting light from the light emitting elements 26, 26, . . . can be further improved.

Further, since the light emitting module 11 and the wire connecting portions 23*b*, 23*b*, 23*b* of the connection terminals 22, 22, 22 are positioned in the placement recess 19*a*, fingers or the like are not inadvertently brought into contact with the wires 31, 31, 31 connecting the wire connecting portions 23*b*, 23*b*, 23*b* and the electrode pads 29, 29, 29, and thus, the disconnection of the wires 31, 31, 31 or the detachment of the wires 31, 31, 31 from the electrode pads 29, 29, 29 and the connection terminals 22, 22, 22 can be prevented.

Meanwhile, for a lighting used outdoors like the vehicle lamp 1, when ambient light such as sunlight is incident thereon in a state where the light emitting elements 26, 26, . . . are lit, the visibility from the outside may be deteriorated, and thus, it may be difficult to recognize the lighting state thereof.

Thus, it is desirable that the light emission luminance of the light emitting elements 26, 26, . . . are changed with respect to the surrounding brightness. As such a configuration, for example, a configuration can be used in which a sensor for detecting the light intensity of external light is provided in the light emitting module 11 or in a portion other than the light emitting module 11, and the light emission luminance of the light emitting elements 26, 26, . . . are changed in accordance with the detection results of the sensor.

By using such a configuration, for example, when the surroundings are dark, a control of decreasing the light emission luminance of the light emitting elements 26, 26, . . . performed. Further, when external light such as sunlight is incident on the vehicle lamp 1, a control of increasing the light emission luminance is performed to increase the visibility from the outside.

Figure 13:
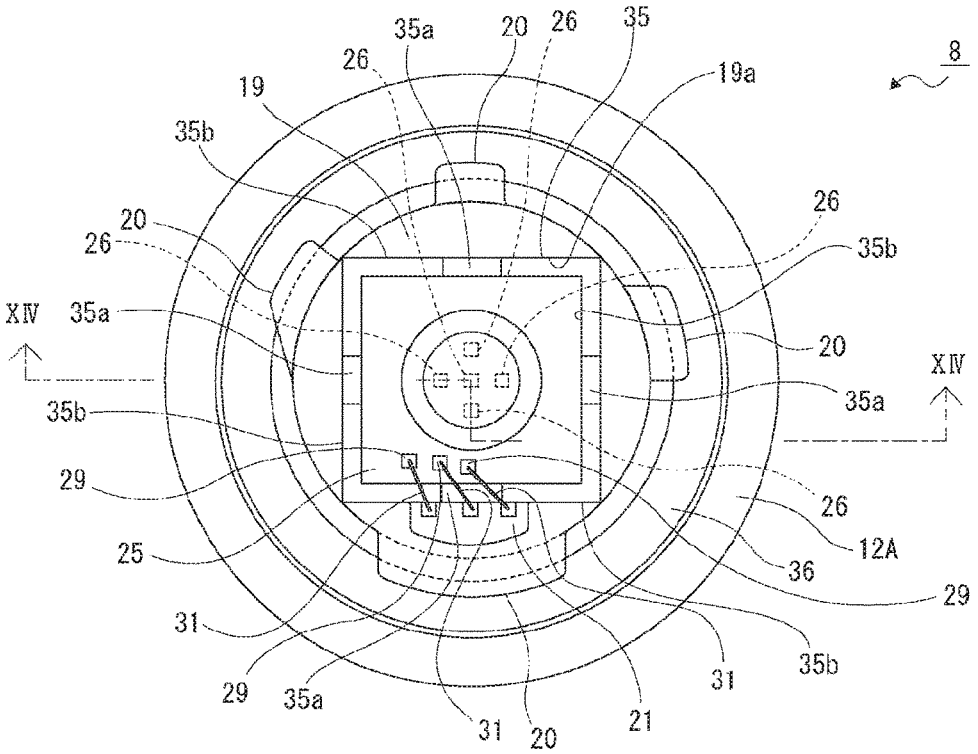
FIG. 13 is a front view conceptually showing a position of the shallow groove portion in a first modification of a resin-molded part.

Next, a first modification of a resin-molded part will be described with reference to FIGS. 13 to 15. Here, FIGS. 13 and 15 are front views schematically showing the light source unit 8.

In a resin-molded part 12A according to a first modification, the shallow groove portions 35*a*, 35*a*, . . . are formed in respective central portions of the four linear portions in the gap 35, and other portions are formed as the deep groove portions 35*b*, 35*b*, . . . (see FIG. 13).

Figure 14:
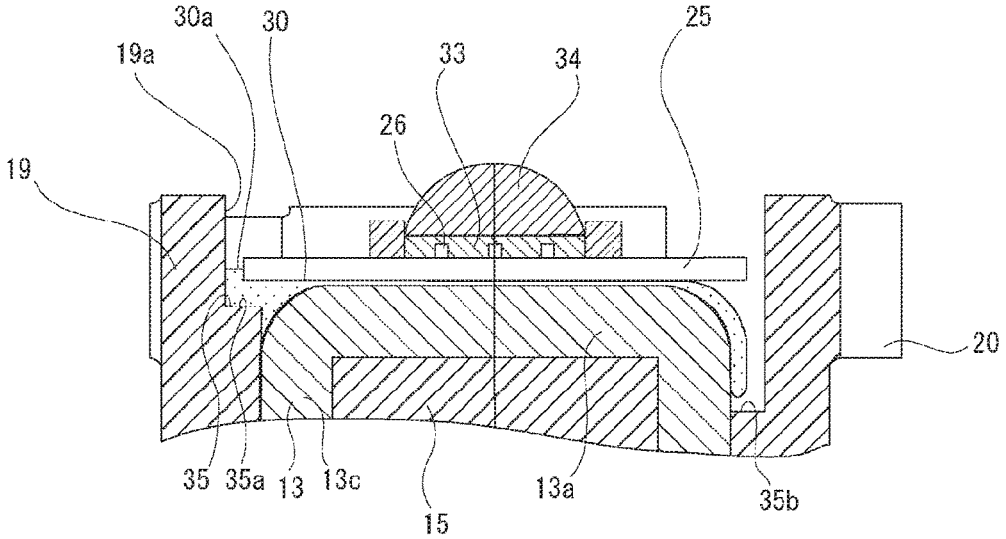
FIG. 14 is an enlarged sectional view taken along the line XIV-XIV shown in FIG. 13.
Figure 15:
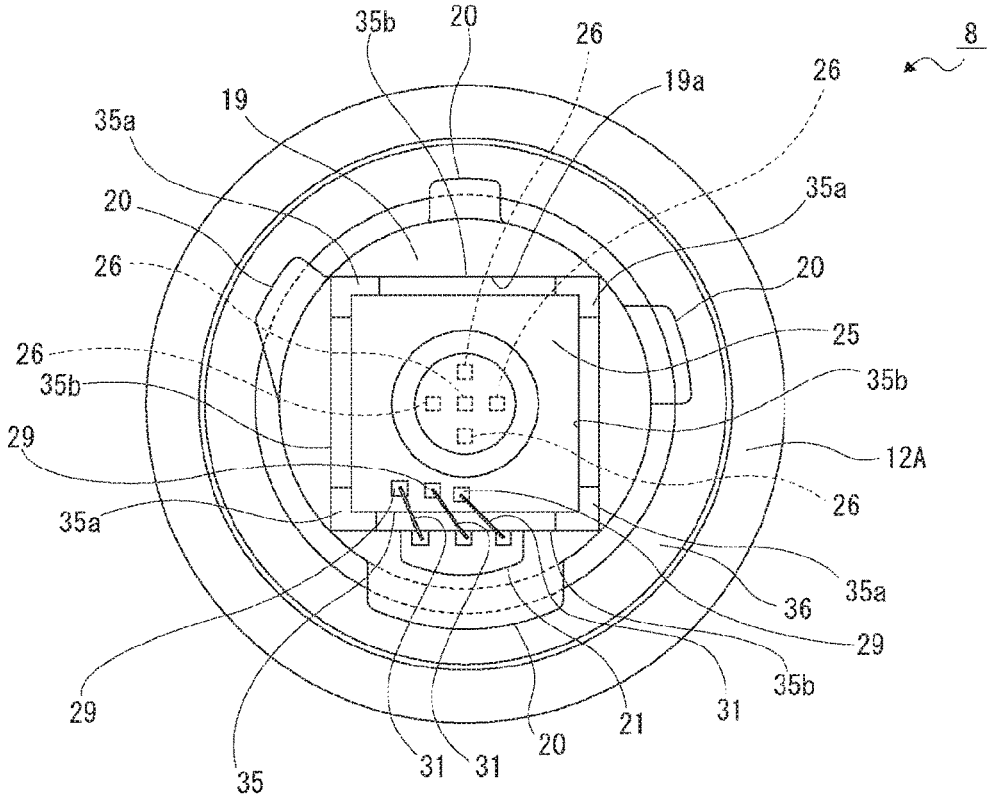
FIG. 15 is a front view conceptually showing the position of the shallow groove portion in the first modification of the resin-molded part.

In the above configuration, when the substrate 25 is attached to the rear surface of the first heat-dissipation portion 13*a* by the adhesive 30, a part of the adhesive 30 is protruded to the rear surface of the shallow groove portions 35*a*, 35*a*, . . . , and most of the adhesive 30 flows into the deep groove portions 35*b*, 35*b*, . . . , as shown in FIG. 14.

Therefore, the adhesive 30 protruding into the shallow groove portion 35*a*, 35*a*, . . . can be visually confirmed. Further, it can be confirmed that the substrate 25 is adhered to the first heat-dissipation portion 13*a*, and the adhesive 30 is uniformly spread between the substrate 25 and the first heat-dissipation portion 13*a*. Further, the shallow groove portions 35*a*, 35*a*, . . . thicker than the deep groove portions 35*b*, 35*b*, . . . in the front and rear direction are respectively formed between the deep groove portions 35*b*, 35*b*, . . . in the gap 35. In this way, the rigidity of the resin-molded part 12A is increased in the entire peripheries of the substrate 25, so that the intensity of the resin-molded part 12A can be also increased.

Meanwhile, the position of the rear surface of the shallow groove portion 35*a* may be any position, as long as the adhesive 30 can protrude to the rear surface of the shallow groove portion 35*a*. The position of the rear surface of the shallow groove portion 35*a* may be the same position as the rear surface of the first heat-dissipation portion 13*a* or may be on the front side of the rear surface of the first heat-dissipation portion 13*a*.

Further, in the resin-molded part 12A, it is desirable that one shallow groove portion 35*a* is positioned on the front side of the wires 31, 31, 31 in the gap 35.

In this way, since a sufficient amount of ultrasonic wave is propagated to the bonding portions between the wires 31, 31, 31 and the electrode pads 29, 29, 29, a strong bonding state of the wires 31, 31, 31 to the electrode pads 29, 29, 29 can be also ensured, in addition to being able to visually confirm the adhesive 30.

Meanwhile, as shown in FIG. 15, the shallow groove portions 35*a*, 35*a*, may be formed at four corners of the gap 35. Further, the shallow groove portion 35*a* is not limited to this position but may be formed in at least one location of the gap 35.

Also in this case, similar to the case where the shallow groove portion 35*a* is positioned at the central portion of the linear portion (see FIGS. 13 and 14), the adhesive 30 protruding into the shallow groove portion 35*a* can he visually confirmed. Further, it can be confirmed that the substrate 25 is adhered to the first heat-dissipation portion 13*a*, and the adhesive 30 is uniformly spread between the substrate 25 and the first heat-dissipation portion 13*a*.

Figure 16:
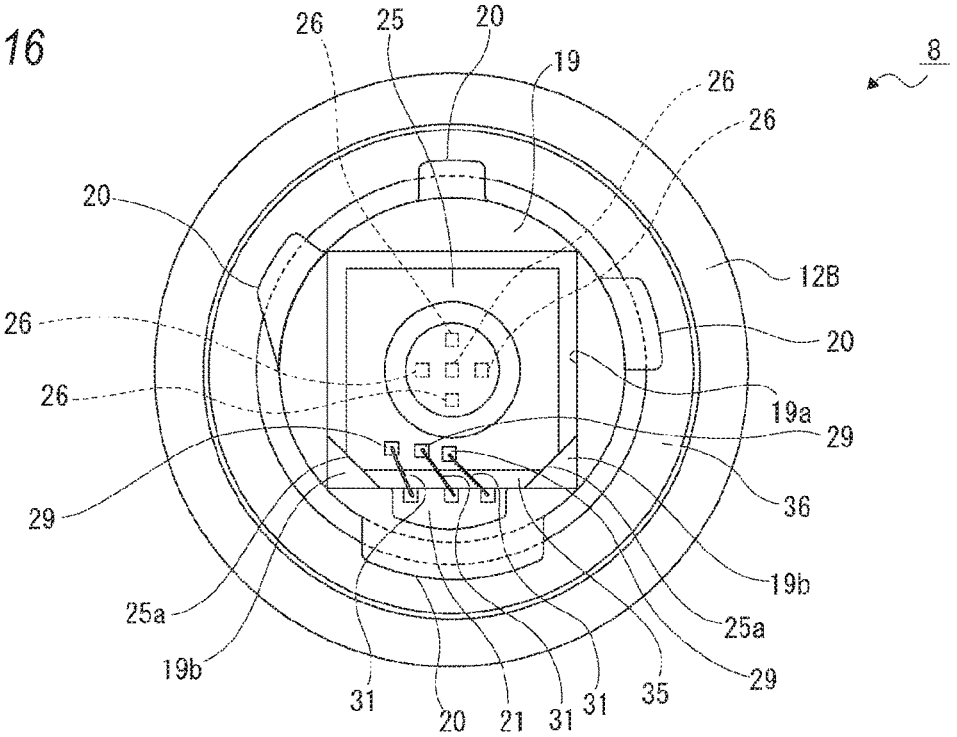
FIG. 16 is a front view conceptually showing a position of the substrate and a positioning portion in a second modification of a resin-molded part.

Next, a second modification of a resin-molded part will be described with reference to FIG. 16. Here, FIG. 16 is a front view schematically showing the light source unit 8.

In a resin-molded part 12B according to a second modification, positioning portions 19*b*, 19*b* are provided in at least two adjacent corners among four corners of the placement recess 19*a* of the substrate placement portion 19. The rear surface of the positioning portion 19*b* is located on the rear side of the front surface (hack surface) of the substrate 25, and the inner side surface of the positioning portion 19*b* is formed as a slope inclined, for example, by 45 degrees with respect to the up and down direction and the right and left direction.

The substrate 25 has, for example, chamfered portions 25*a*, 25*a* at two adjacent corners. The chamfered portions 25*a*, 25*a* are chamfered at the same angle as the positioning portions 19*b*, 19*b*.

In the above configuration, when the substrate 25 is placed on the rear surface of the first heat-dissipation portion 13*a*, the chamfered portions 25*a* are abutted against the inner side surface of the positioning portions 19*b*, so that the chamfered portions 25*a* make surface contact with the positioning portions 19*b*. In this way, the substrate 25 is positioned with respect to the substrate placement portion 19, and rotation of the substrate 25 in the vertical plane is prevented.

Therefore, since the position of the substrate 25 with respect to the substrate placement portion 19 is determined only by abutting the chamfered portions 25*a*, 25*a* against the inner side surface of the positioning portions 19*b*, 19*b*, respectively, the positioning of the substrate 25 with respect to the substrate placement portion 19 can be easily performed. Further, since the high positional accuracy of the substrate 25 with respect to the resin-molded part 12B is ensured, the high positional accuracy of the light emitting elements 26, 26, . . . with respect to the lamp body 2 can be easily ensured.

Meanwhile, the positioning portion 19*b* may be provided at three or four corners among the four corners of the placement recess 19*a*. In this case, three or four chamfered portions 25*a* may be formed in the substrate 25, thereby positioning the substrate 25 with respect to the substrate placement portion 19.

However, as described above, since the positioning can be performed by providing the positioning portions 19*b*, 19*b* at two adjacent positions, it is only necessary to ensure good machining accuracy of two positioning portions 19*b*, 19*b* and two chamfered portions 25*a*, 25*a*. Therefore, the number of parts requiring good machining accuracy can be small, and thus, the manufacturing cost of the resin-molded part 12B can be reduced.

REFERENCE NUMERALS LIST

1 . . . Vehicle Lamp, 8 . . . Light Source Unit, 9 . . . Socket Housing, 10 . . . Power Supply Body, 11 . . . Light Emitting Module, 15*a* . . . Positioning Hole, 20 . . . Engaging Portion, 21 . . . Terminal Holding Portion, 22 . . . Connection terminal, 25 . . . Substrate, 26 . . . Light Emitting Element, 29 . . . Electrode Pad, 31 . . . Wire (Conductive Connecting Portion), 37 . . . Shielding Member

The invention claimed is:

1. A light source unit comprising:

a light emitting element, a wiring pattern on which the light emitting element is mounted, an electrode pad connected to the wiring pattern, a substrate on which the wiring pattern is formed and on which the electrode pad is mounted, a power supply body which supplies external power to the electrode pad, and a socket housing which holds the substrate, the light emitting element and the power supply body, the socket housing including a placement recess in which the light emitting element and the substrate are disposed, and an engaging portion engaged with an engaging protrusion;

wherein the power supply body includes a terminal holding portion formed of an insulating resin material and a connection terminal supported by the terminal holding portion, the connection terminal connected to an external power supply, wherein the connection terminal of the power supply body and the electrode pad are connected to each other by a conduction connecting part, and wherein a gap is formed between an outer peripheral surface of the substrate and an inner peripheral surface of the placement recess, the gap comprising at least one shallow groove portion and at least one deep groove portion.

2. The light source unit according to claim 1, wherein one end portion of the connection terminal of the power supply body is located adjacent to the substrate, and wherein at least portions of the power supply body excluding both end portions thereof are located inside the socket housing.

3. The light source unit according to claim 1, wherein the terminal holding portion and the connection terminal of the power supply body are integrally molded together, and wherein the power supply body and the socket housing are integrally molded together.

4. The light source unit according to claim 1, wherein the light source unit further includes a shielding member shielding at least the conduction connecting part, wherein a positioning hole is formed in one of the socket housing and the shielding member and a positioning pin inserted through the positioning hole is provided in the other one of the socket housing and the shielding member, and wherein the shielding member is attached to the socket housing in a state where the positioning pin is inserted through the positioning hole.

5. A vehicle lamp comprising the light source unit according to claim 1.

6. The light source unit according to claim 1, wherein the shallow groove portion is disposed on a side of the substrate in which the electrode pad and the power supply body are connected to each other by the conduction connecting part.

7. The light source unit according to claim 1, wherein a surface adhesive which bonds the substrate to the socket housing is disposed in the gap.

8. A light source unit comprising:

a light emitting element, a wiring pattern on which the light emitting element is mounted, an electrode pad connected to the wiring pattern, a substrate on which the wiring pattern is formed and on which the electrode pad is mounted, a power supply body which supplies external power to the electrode pad, and a socket housing which holds the substrate, the light emitting element and the power supply body, the socket housing including an engaging portion engaged with an protrusion, wherein a placement recess in which the substrate is placed is formed in the socket housing, wherein a part of a connection terminal to be connected to a power supply circuit is positioned in a portion of the placement recess between the substrate and the engaging portion, wherein the connection terminal and the electrode pad are connected to each other by a conduction connecting part, and wherein a gap is formed between an outer peripheral surface of the substrate and an inner peripheral surface of the placement recess, the gap comprising at least one shallow groove portion and at least one deep groove portion.

9. A vehicle lamp comprising the light source unit according to claim 8.

* * * * *